US008113127B2

(12) United States Patent
Helline

(10) Patent No.: US 8,113,127 B2
(45) Date of Patent: Feb. 14, 2012

(54) CLEANING TRAY

(76) Inventor: Jeffrey J. Helline, Port Clinton, OH (US)

( * ) Notice: Subject to any disclaimer, the term of this patent is extended or adjusted under 35 U.S.C. 154(b) by 33 days.

(21) Appl. No.: 12/722,161

(22) Filed: Mar. 11, 2010

(65) Prior Publication Data

US 2010/0162928 A1 Jul. 1, 2010

Related U.S. Application Data

(63) Continuation-in-part of application No. 12/257,087, filed on Oct. 23, 2008, now Pat. No. 8,015,927.

(60) Provisional application No. 61/076,168, filed on Jun. 27, 2008.

(51) Int. Cl.
*A47B 85/00* (2006.01)

(52) U.S. Cl. ..... 108/26; 108/98

(58) Field of Classification Search ..... 108/97, 108/98, 25, 26, 24, 28; 312/280–282; 297/188.2, 297/153; 193/2 A; 220/908.3, 910; 248/230.6, 248/231.71, 318; 211/90.01; 269/15; 43/55; 452/194; 206/315.11; 15/257.9
See application file for complete search history.

(56) References Cited

U.S. PATENT DOCUMENTS

| | | | | | |
|---|---|---|---|---|---|
| 1,006,994 | A | * | 10/1911 | Barnes | 248/231.71 |
| 1,897,717 | A | | 2/1933 | Appel | |
| 2,090,176 | A | * | 8/1937 | Besancon | 248/231.81 |
| 2,329,660 | A | * | 9/1943 | Smith | 220/23.83 |
| 2,457,285 | A | | 12/1948 | Stepner | |
| 2,695,831 | A | * | 11/1954 | Sigal | 312/246 |
| 2,920,757 | A | * | 1/1960 | Garman | 206/45.21 |
| 3,107,636 | A | * | 10/1963 | Knight | 108/102 |
| 3,325,038 | A | * | 6/1967 | Ferney | 52/11 |
| 3,744,645 | A | * | 7/1973 | Hochman | 211/86.01 |
| 3,949,880 | A | * | 4/1976 | Fortunato | 211/119.003 |
| 4,155,310 | A | | 5/1979 | Gregory | |
| 4,445,659 | A | * | 5/1984 | LaChance | 248/210 |
| D324,791 | S | | 3/1992 | Hoover | |
| D356,468 | S | * | 3/1995 | Beck et al. | D6/406.5 |
| 5,474,494 | A | * | 12/1995 | Sims | 452/194 |
| 6,026,972 | A | * | 2/2000 | Makowski | 220/495.08 |
| 6,152,047 | A | * | 11/2000 | Mac Namara | 108/26 |
| 6,371,470 | B1 | * | 4/2002 | Ward | 269/289 R |
| 6,802,263 | B1 | | 10/2004 | Kolb | |
| 6,880,470 | B2 | | 4/2005 | Sidor et al. | |
| 7,290,490 | B2 | | 11/2007 | Goldberg et al. | |

* cited by examiner

*Primary Examiner* — Janet M Wilkens
(74) *Attorney, Agent, or Firm* — Michael J. Gallagher; David J. Dawsey; Gallagher & Dawsey, Co., LPA

(57) ABSTRACT

A cleaning tray for the improved cleaning of surfaces is provided. The tray is releasably engagable with a plurality of different shaped horizontal surfaces, and allows the horizontal surface to overhang at least a portion of a collecting portion, with detritus easily swept from the horizontal surface into the collecting portion, and then into a waste container.

10 Claims, 10 Drawing Sheets

CLEANING TRAY

CROSS-REFERENCE TO RELATED APPLICATIONS

This application is a continuation-in-part of U.S. patent application Ser. No. 12/257,087, filed Oct. 23, 2008, now U.S. Pat. No. 8,015,927 which claims priority to U.S. Provisional Application No. 61,076,168 filed on Jun. 27, 2008; the contents of which are incorporated by reference as if completely written herein.

TECHNICAL FIELD

The present invention relates to the field of a cleaning tray which is a table attachment providing a removable depository for refuse and litter from an area, in particular, from a horizontal area.

STATEMENT REGARDING FEDERALLY SPONSORED RESEARCH OR DEVELOPMENT

Not Applicable

BACKGROUND OF THE INVENTION

Various cleaning trays are provided in the prior art. For example, one patent teaches a waste disposal apparatus with a retractable drop chute for delivering waste to a waste container which is movably connected beneath a surface covering the entire waste container. Another patent teaches a tray having a refuse receptacle attachable to a chair. Still another patent provides a debris receptacle attachable to a cutting board. Even another patent teaches a work surface device aiding in disposal of items, while another patent teaches a combination of a table for a receptacle and a waste container. Still even another patent teaches a table and trash disposal combined device.

While the above-described devices fulfill their respective and particular objects and requirements, they do not describe a cleaning tray that provides for the advantages of the present invention; therefore, a need exists for an improved cleaning tray that is designed to hook onto a table, having in some embodiments a built-in storage compartment for cleaning supplies, the tray having inwardly sloping wedges to assist in wiping crumbs and other waste into a trash receptacle in the center of the tray, and/or a hook upon which a removable waste bag is carried.

In this respect, the present invention substantially departs from the conventional concepts and designs of the prior art.

SUMMARY OF THE INVENTION

Numerous variations, modifications, alternatives, and alterations of the various preferred embodiments, processes, and methods may be used alone or in combination with one another as will become more readily apparent to those with skill in the art, with reference to the following detailed description of the preferred embodiments and the accompanying figures and drawings.

In view of the foregoing known types of cleaning trays now present in the prior art, the present invention provides a novel cleaning tray. As such, the general purpose of the present invention, which will be described subsequently in greater detail, is to provide a new and improved cleaning tray which has all the advantages of the prior art mentioned heretofore and many novel features that result in a cleaning tray which is not anticipated, rendered obvious, suggested, or even implied by the prior art, either alone or in any combination thereof.

To attain this, the present cleaning tray in some embodiments provides a primary body having two arms forming a C-shape to hook the tray onto a table, a built-in storage compartment for cleaning supplies, the tray having inwardly sloping wedges to assist in wiping crumbs and guiding other waste into a trash receptacle in the center of the tray, and a hook upon which a removable waste bag is carried.

The present cleaning tray may be used in restaurants, lounges, cafeterias and the like to assist individuals, including waitresses, servers, busboys, and caterers, in cleaning tables and disposing of trash left on and around tables. The present tray may be used by anyone who needs to clean up a table and the surrounding area. Use of the present tray further assists in keeping floors and tables, and even booths and chairs, clean and sanitary which, in turn, reduces the potential for insect and rodent invasion. By keeping crumbs from falling on the floor during table cleaning, the tray also helps to keep the crumbs from being stepped on and embedded into the floor. The present tray is a timesaving tool in that several tables may be sequentially cleaned without having to return to a receptacle to empty both liquid and solid debris, such as empty wrappers and bags, paper cups, condiment packets, stirrers, sugar and creamer packets, food crumbs, and the like, as each table is cleaned, while simultaneously in some embodiments providing ready access to cleaning supplies, such as spray cleaners and cloths, without having to grab up the cleaning supplies in one's hands and/or underneath one's arms, which is often a difficult balancing act to achieve. Thus, the present tray also makes the atmosphere more aesthetically pleasing and clean for patrons. The present tray is easy to use, simple to clean, convenient, effective, durable, timesaving and reasonably priced.

The present cleaning tray has a smooth surface for easier cleaning of the tray after use and is lightweight enough to be easily carried from table to table while being durable enough to support cleaning supplies and several tables' worth of trash. The tray may be made of injection molded plastic material, such as polypropylene or the like, or other suitable materials which allow the tray to serve its objects and purposes.

The present cleaning tray may be produced in a wide variety of colors. The colors used to produce the cleaning tray may be colors identified with a particular business. Further, the tray may be embellished with various names and logos of businesses such as commercial eating and drinking establishments.

Numerous objects, features and advantages of the cleaning tray will be readily apparent to those of ordinary skill in the art upon reading the following detailed description of presently preferred, but nonetheless illustrative, embodiments of the cleaning tray when taken in conjunction with the accompanying drawings. In this respect, before explaining the current embodiments of the cleaning tray in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

BRIEF DESCRIPTION OF THE DRAWINGS

Without limiting the scope of the cleaning tray as claimed below and referring now to the drawings and figures, all shown not-to-scale:

Figure 1:
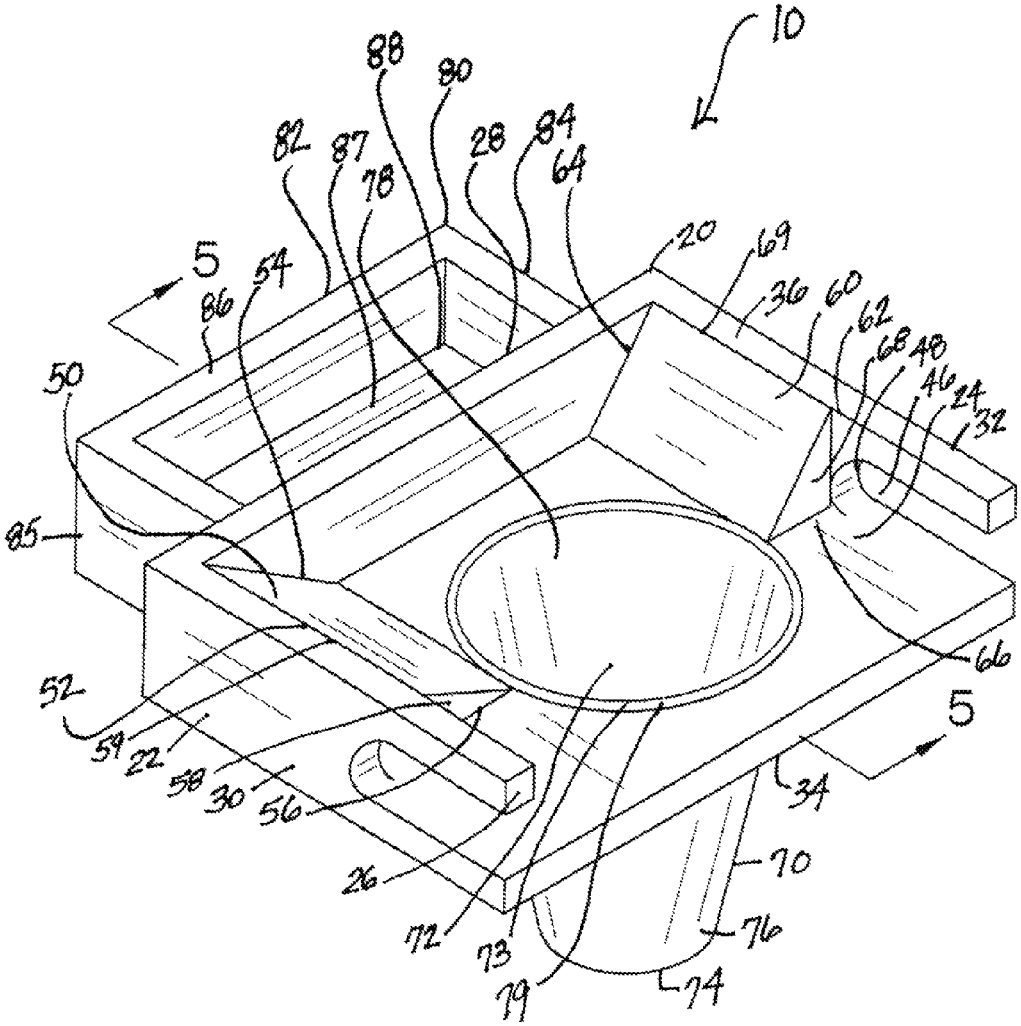
FIG. 1 is an elevated perspective view of an embodiment of a cleaning tray.

These drawings are provided to assist in the understanding of the exemplary embodiments of the device as described in more detail below and should not be construed as unduly limiting the device. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

A cleaning tray (10) for the improved cleaning of tables and other surfaces enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the present embodiments of the device, and is not intended to represent the only form in which the present device may be constructed or utilized. The description sets forth the designs, functions, means, and methods of implementing the device in connection with the illustrated embodiments. It is to be understood, however, that the same or equivalent functions and features may be accomplished by different embodiments that are also intended to be encompassed within the spirit and scope of the claimed device.

With reference now to the drawings, and in particular to FIGS. 1-12 thereof, a preferred embodiment of the present cleaning tray employing the principles and concepts of the present cleaning tray and generally designated by the reference numeral 10 will be described.

Referring to FIGS. 1-7, the present cleaning tray (10) removably engages a table (90) having an outer edge (92). The cleaning tray (10) provides a main body (20), a first wedge (50) and a second wedge (60) inside the main body (20), a receptacle (70) for trash disposal centered in the main body (20), and a storage compartment (80) permanently attached to the main body (20), all seen well in FIG. 1.

The parallelepiped main body (20) has an exterior portion (22), an interior portion (24), a front side (26), a rear side (28), a left side (30), a right side (32), a bottom side (34), a top edge (36), and an aperture (42) having a first perimeter (44). The aperture (42) is centered in the bottom side (34) of the interior portion (24). The left side (30) and right side (32) each have an elongated C-shaped opening (46) continuously extending rearwardly from the front side (26), again as seen well in FIG. 1.

The opening (46) is about one-half the length of the main body (20). The opening (46) has a rear apex (48). The opening (46) removably slideably engages a table (90) outer edge (92), which allows the present cleaning tray to removably engage a table (90) outer edge (92). The opening (46) forms arm-like extensions that hook onto the table (90) outer edge (92), as seen well in FIG. 7.

Figure 3:
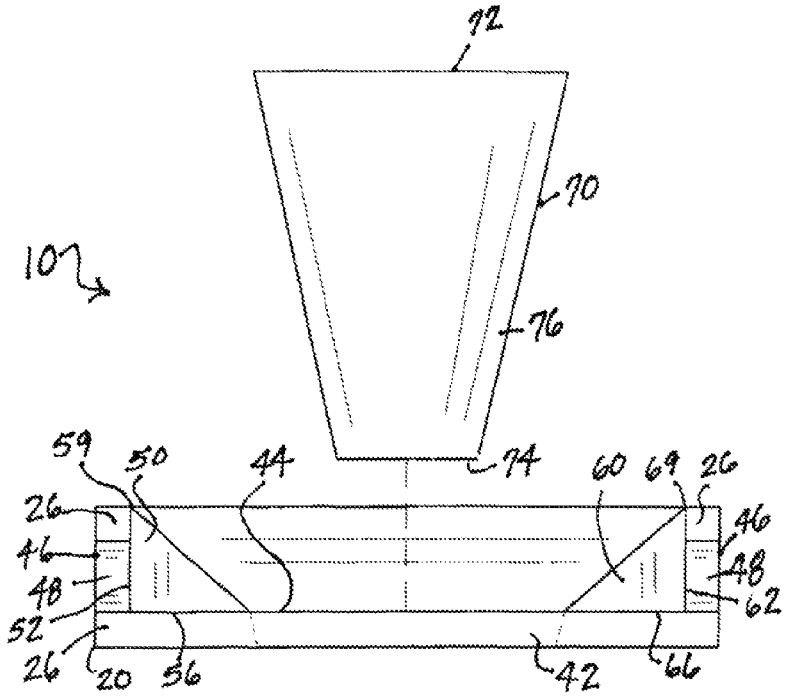
FIG. 3 is a partially disassembled front elevation view of the embodiment of FIG. 1.
Figure 4:
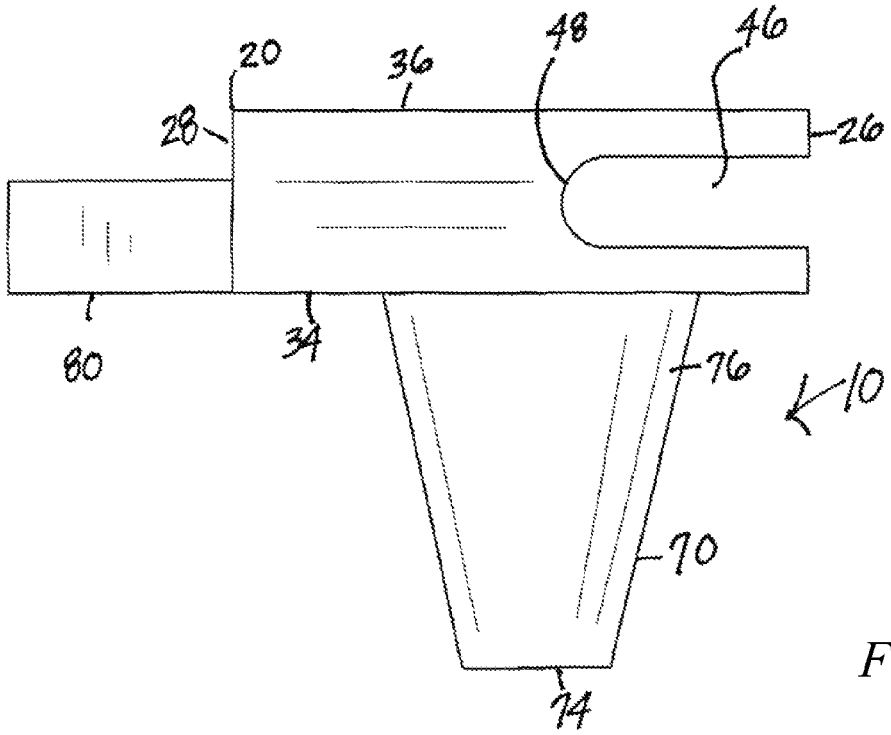
FIG. 4 is a side elevation view of the embodiment of FIG. 1.

As seen well in FIGS. 1 and 3, the first wedge (50) has a first interior edge (52) permanently attached to the interior portion (24) on the left side (30), a first proximal edge (54) permanently attached to the interior portion (24) on the rear side (28), a first bottom edge (56) permanently attached to the interior portion (24) on the bottom side (34), a first distal edge (58) adjacent to the rear apex (48) of the C-shaped opening (46) and a first upper apex (59) adjacent to the main body (20) top edge (36).

Also as seen well in FIGS. 1 and 3, the second wedge (60) has a second interior edge (62) permanently attached to the interior portion (24) on the right side (32), a second proximal edge (64) permanently attached to the interior portion (24) on the rear side (28), a second bottom edge (66) permanently attached to the interior portion (24) on the bottom side (34), a second distal edge (68) adjacent to the rear apex (48) of the C-shaped opening (46), and a second upper apex (69) adjacent to the main body (20) top edge (36). Each wedge (50), (60) may have about a 45-degree slope as illustrated to assist in wiping crumbs and guiding other waste into the receptacle (70) in the center of the bottom side (34), as seen well in FIG. 6. The slope may vary but only insofar as the slope accomplishes the purpose of assisting in wiping crumbs and guiding other waste into the receptacle (70).

Figure 2:
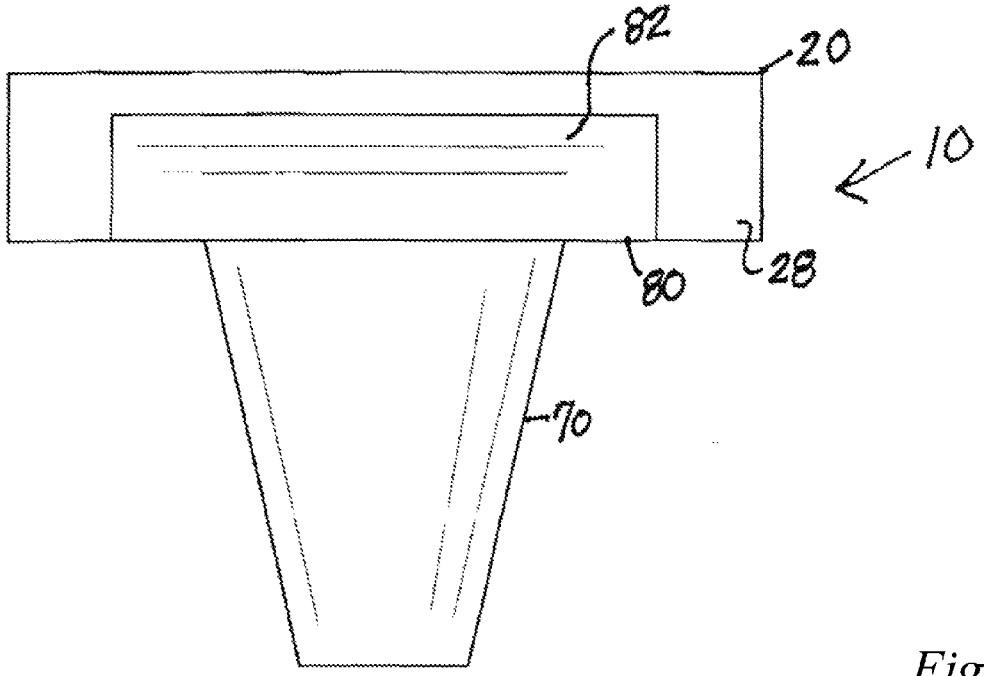
FIG. 2 is a back elevation view of the embodiment of FIG. 1.

A conical receptacle (70), seen well in FIGS. 2 and 3, removably engages the aperture (42). The receptacle (70) has an open top end (72) having a second perimeter (73), a closed bottom end (74), a continuous first wall (76) between the top end (72) and bottom end (74), an interior cavity (78) defined by the top end (72), the bottom end (74), and the first wall (76), and a continuous lip (79). The lip (79) extends outwardly from the top end (72) second perimeter (73) and removably engages the aperture (42) first perimeter (44) adjacent the bottom side (34).

Figure 5:
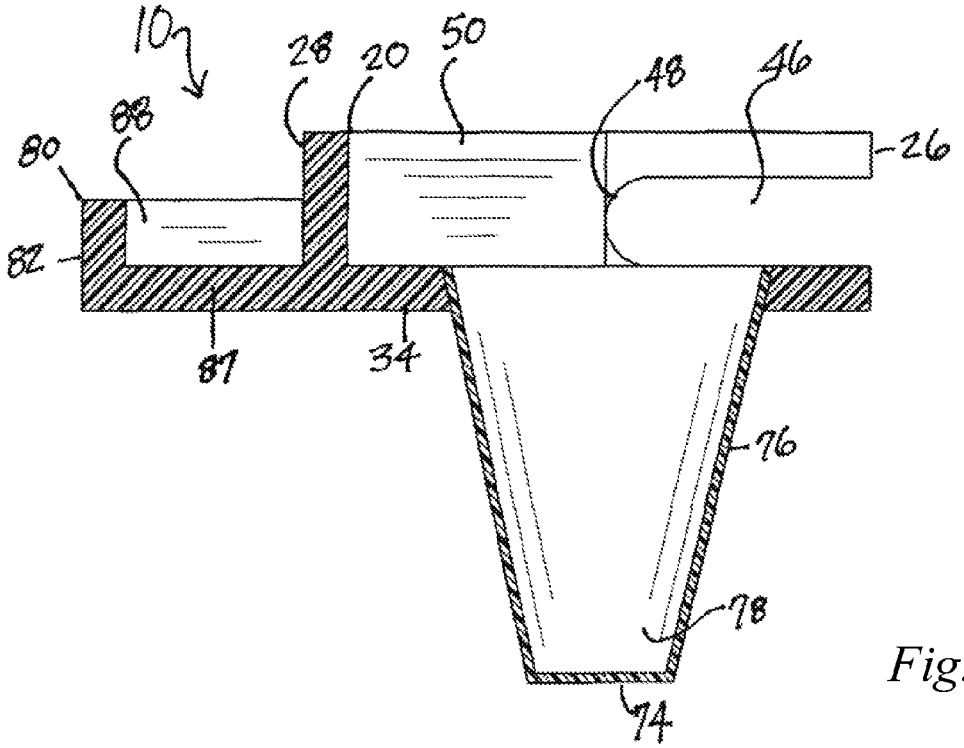
FIG. 5 is a cross-sectional side view of the embodiment of FIG. 1.
Figure 6:
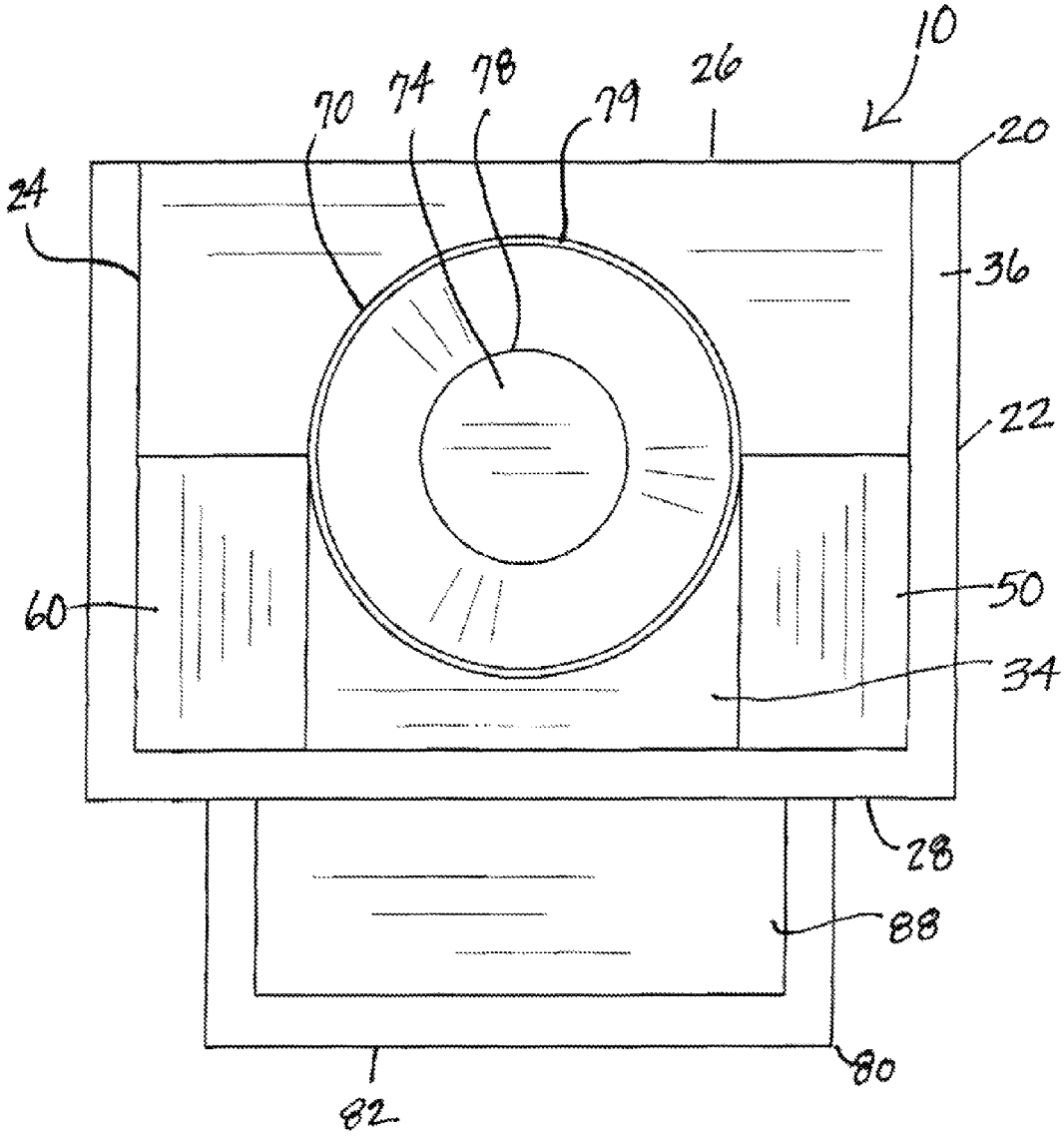
FIG. 6 is a top plan view of the embodiment of FIG. 1.
Figure 7:
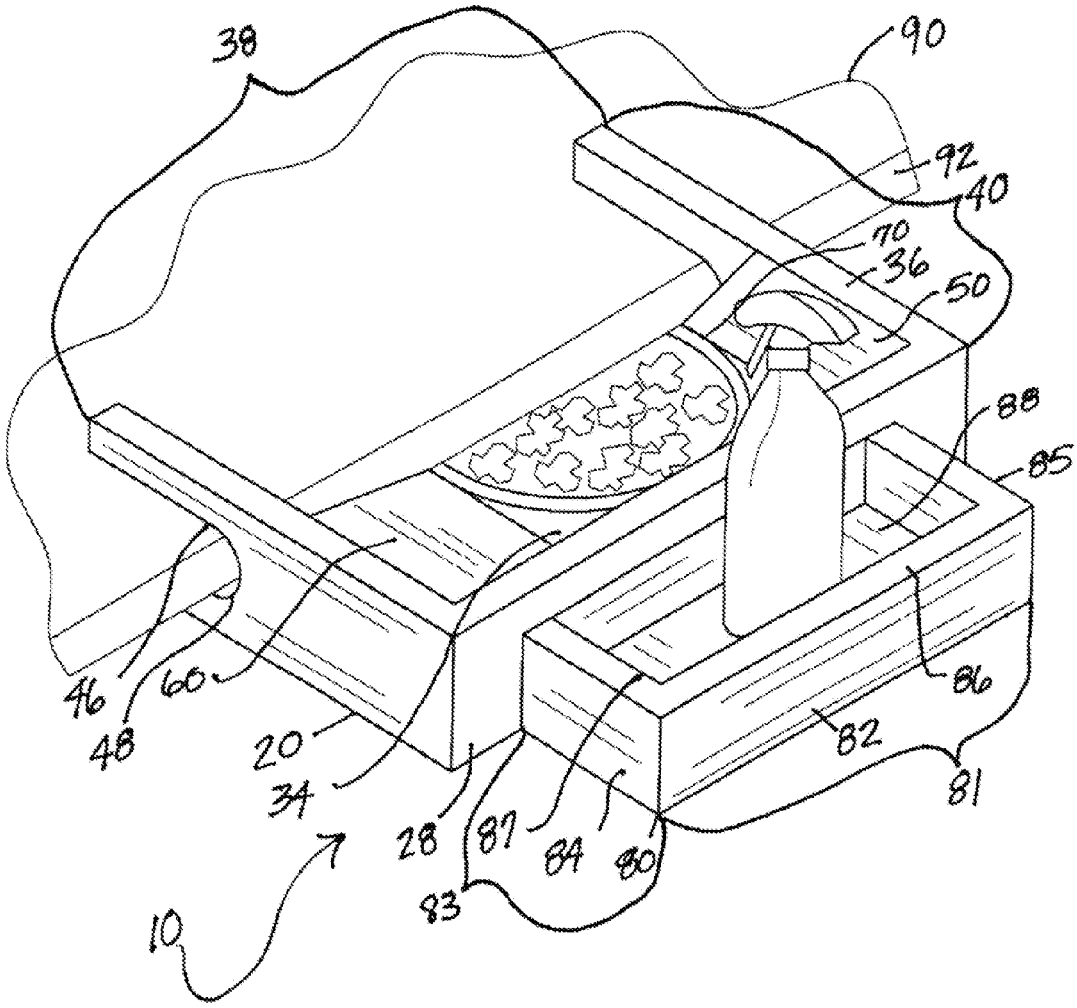
FIG. 7 is an elevated perspective view of a portion of the embodiment of FIG. 1 showing a cleaning tray in use on a horizontal surface.

As seen well in FIGS. 1 and 5, the parallelepiped compartment (80) may extend rearwardly from the main body (20) rear side (28). The compartment (80) has a rear edge (82), a right edge (84), a left edge (85), an upper edge (86), a bottom wall (87), and a rectangular internal cavity (88) defined by the main body (20) rear side (32), the compartment (80) rear edge (82), the right edge (84), the left edge (85), the upper edge (86) and the bottom wall (87).

In a preferred embodiment, the main body (20) of the present cleaning tray (10) has a first length (40) of about 13 inches long, a first width in a range of about 18 to 22 inches wide, an external height of about 4 inches, and inwardly sloping first and second wedges (50), (60) each having a length of about 5 inches. Also in a preferred embodiment, the length from the front side (26) of the main body (20) to the rear apex (48) of the opening (46) is about 4 inches. The opening (46) is about 2 inches in height in a preferred embodiment. The conical receptacle (70), in a preferred embodiment, has a 4-inch radius at the open top end (72) and a height of about 11 inches. Also, in a preferred embodiment, the storage compartment has a second width (81) of about 13 inches, a second length (83) of about 4 inches and an internal depth of about 4 inches.

Thus, the compartment has a second width about ⅔ as wide as a main body first width and a second length about ⅓ as long as a main body first length in a preferred embodiment. While the dimensions may vary in other embodiments, the dimensions must permit the present cleaning tray to attach and balance properly to a table while supporting trash disposed of therein and also supporting cleaning supplies stored in the cleaning compartment and to be easily lifted and carried. The present cleaning tray (10) may be formed of a smooth, lightweight, durable material, including injection molded plastic, polypropelene, and other materials having similar properties.

In use, it can now be understood that the cleaning tray (10) provides a useful item for assisting in the clean up of tables. To use the present cleaning tray (10), a user may simply place cleaning supplies, including cleaners and rags or sponges, in the storage compartment (80) and removably attach the tray (10) to the outer edge (92) of a table (90) by sliding each opening (46) on the left side (20) and right side (32) over the outer edge (92) of the table (90), such as seen in a typical embodiment in FIG. 7. The user may dispose of trash left on the table or nearby by placing the trash in the receptacle (70).

Figure 8:
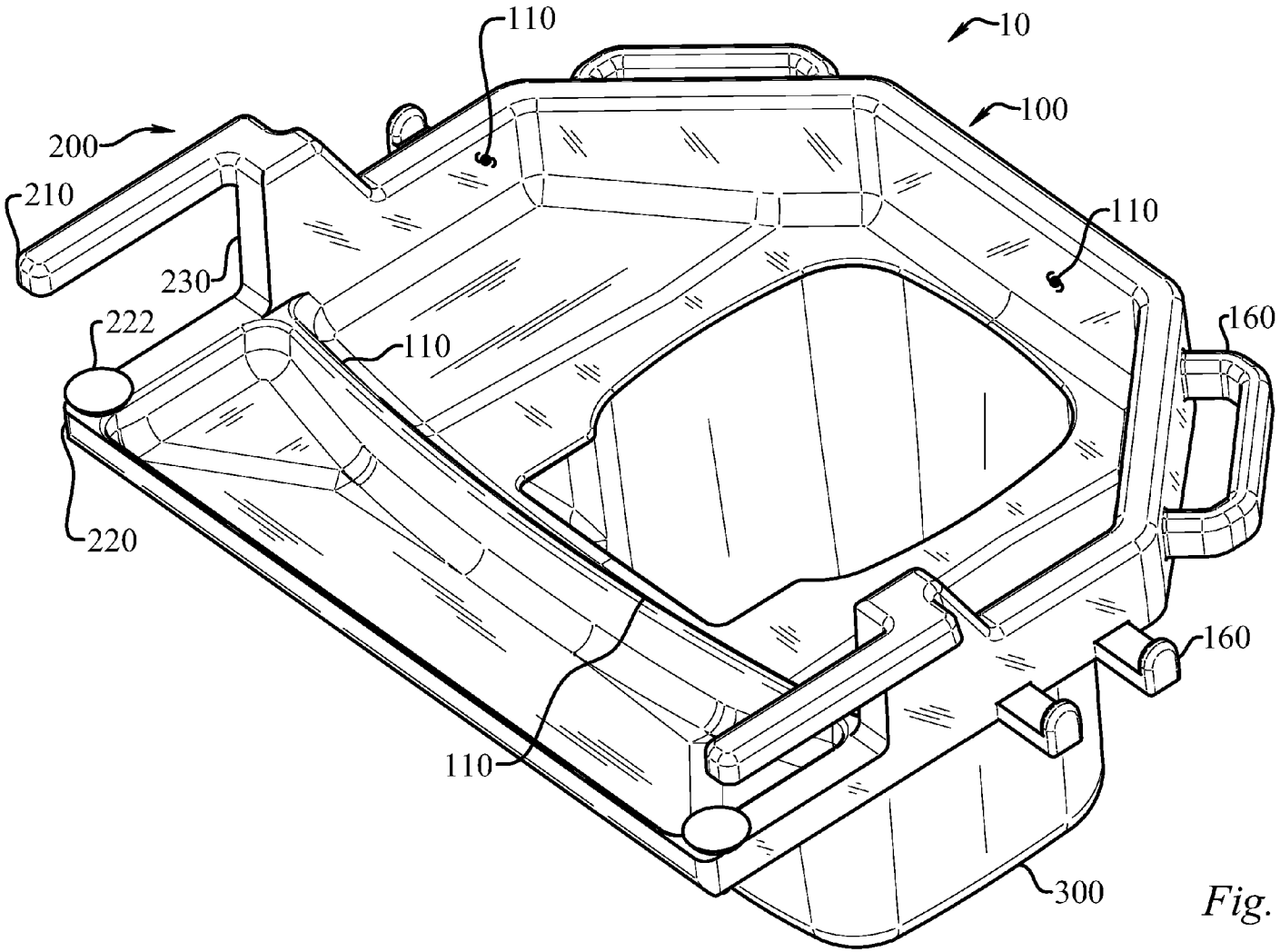
FIG. 8 is an elevated perspective view of another embodiment of a cleaning tray.
Figure 9:
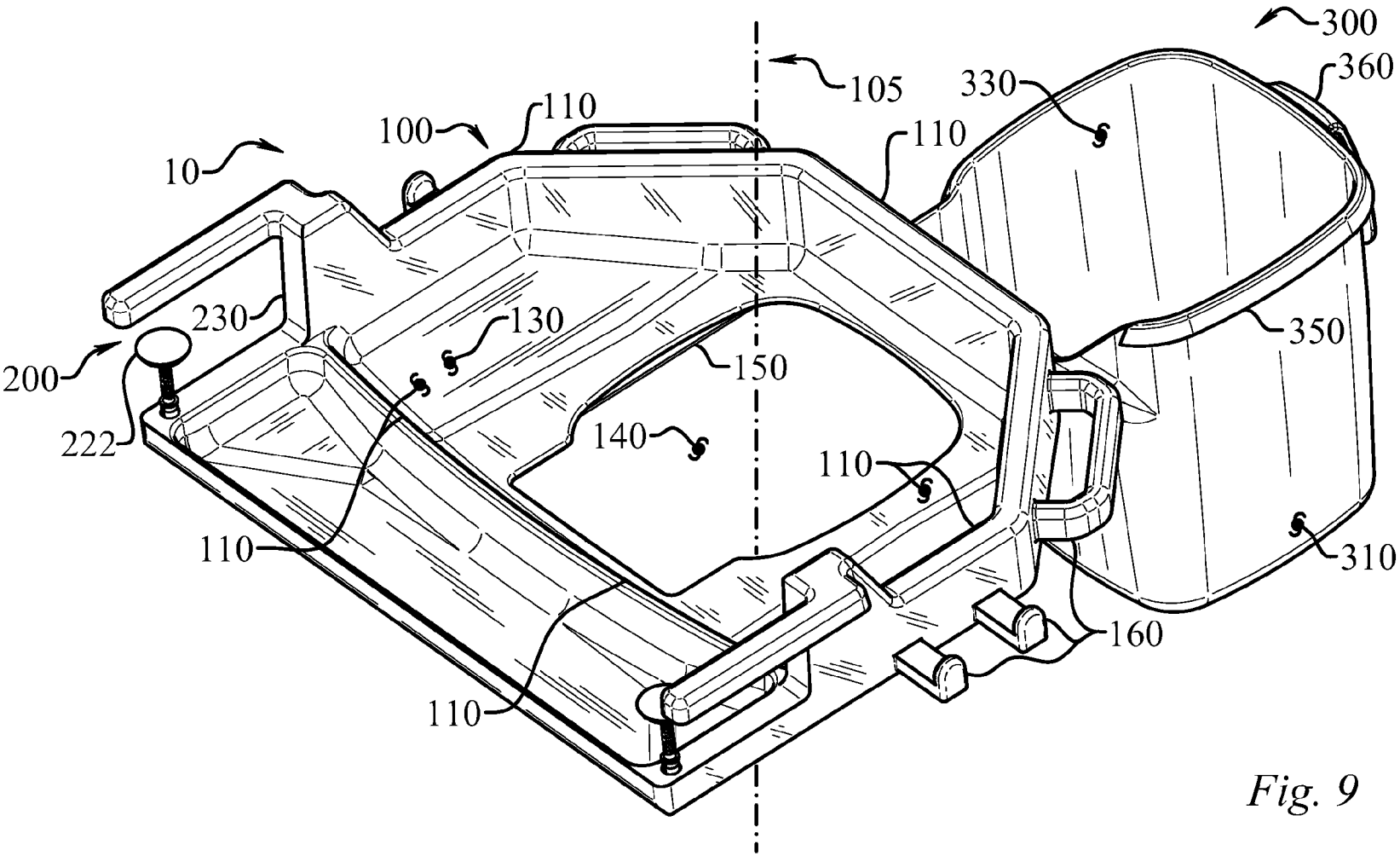
FIG. 9 is a partially disassembled elevated perspective view of the embodiment of FIG. 9.

In another series of embodiments, all of which may appear in whole or in part with the features previously described in other embodiments, a cleaning tray (10), may be seen, as in FIGS. 8-12, to have a collecting portion (100), an attachment portion (200) and a waste container (300), all of which may be seen well in FIGS. 8-9.

Figure 10:
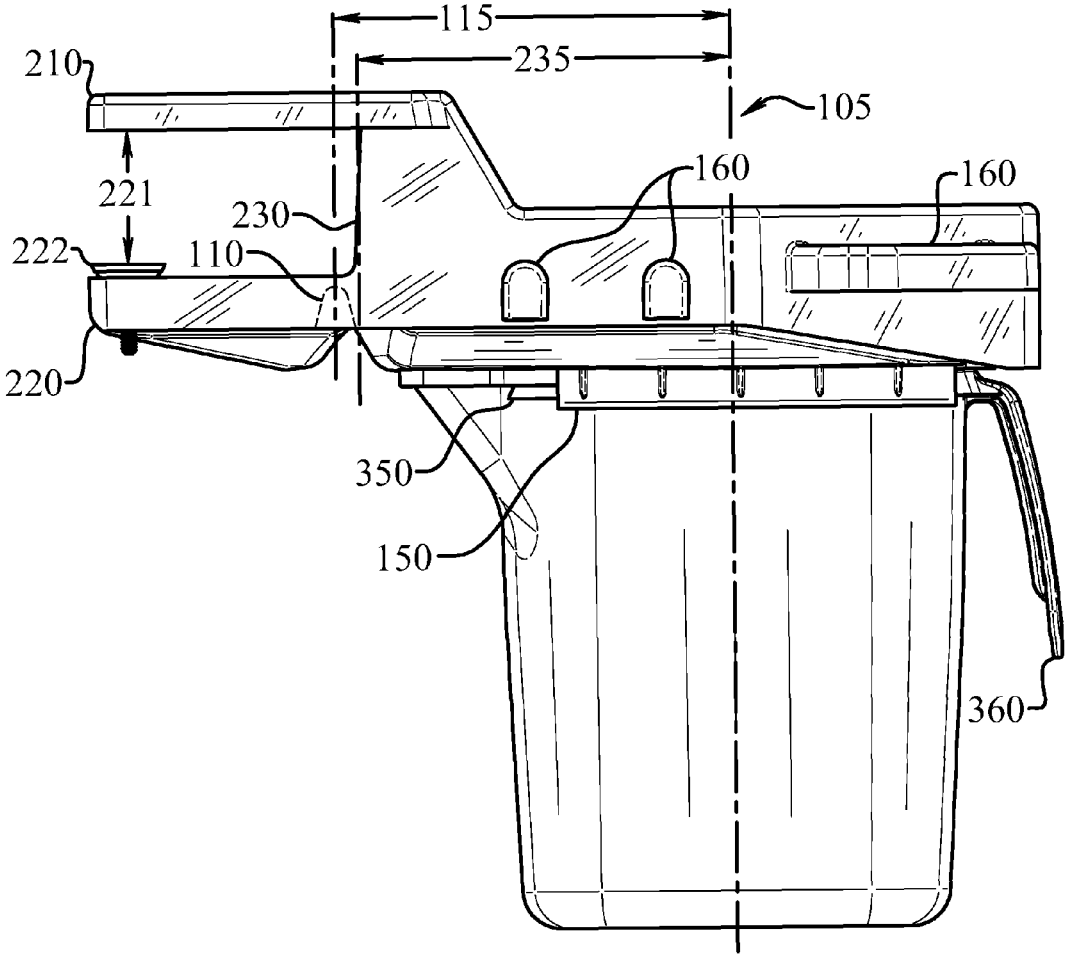
FIG. 10 is a side elevation view of the embodiment of FIG. 8.

The collecting portion (100) may be formed with a central axis (105), seen in FIG. 9, which for the purposes of this specification is defined as an orthogonal axis passing through a center of the cleaning tray (10). The collecting portion (100) has at least one collecting portion wall (110) enclosing a collecting portion volume (130), which is in fluid communication with the waste container (300) through a collecting portion fenestration (140). The collecting portion wall (110), as seen in FIG. 10, may be spaced at least one predetermined distance from the central axis (105), thereby defining at least one collecting portion wall—central axis radius (115). The collecting portion (100) may also have a releasable collecting portion—waste container attachment (150).

The attachment portion (200), as seen in FIGS. 8-12, has an upper engagement portion (210) and a lower engagement portion (220) having a predetermined distance between the upper engagement portion (210) and a lower engagement portion (220) defining an inter-engagement portion height (221), seen well in FIG. 10. This allows the cleaning tray (10) to releasably engage a horizontal surface (H) placed between the upper engagement portion (210) and the lower engagement portion (220) in the predetermined engagement portion height (221), as seen well in FIGS. 11 and 12. An engagement portion stop (230) lies at a predetermined distance from the collecting portion central axis (105), thereby defining at least one central axis—engagement portion radius (235), also seen well in FIG. 10.

The waste container (300), seen well in FIG. 9, has at least one waste container wall (310) defining a waste container volume (330) in fluid communication with the collecting portion (200) through the collecting portion fenestration (140). Similar to and engaging the releasable collecting portion—waste container attachment (150), the waste container (300) has a releasable waste container—collecting portion engagement (350).

Figure 11:
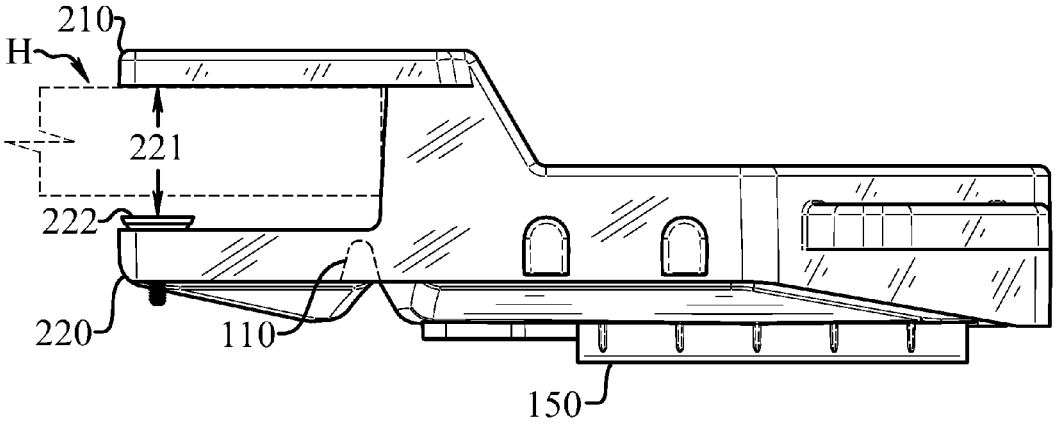
FIG. 11 is a side elevation view of a portion of the embodiment of FIG. 8; showing a first position adjustment in the inter-engagement portion height (221)

As seen well in FIGS. 10 and 11, at least one collecting portion wall—central axis radius (115) is greater than or equal to at least one central axis—engagement portion radius (235). This allows a horizontal surface (H), which by way of example only and not limitation, may be a table top, counter edge, or the like placed between the upper engagement portion (210) and the lower engagement portion (220) in the predetermined engagement portion height (221), and against the engagement portion stop (230), to overhang at least a portion of collecting portion wall (110), and thereby allow any materials from the horizontal surface (H) to be swept from the overhanging portion and fall by gravity into the collecting portion volume (130).

In other embodiments, at least two collecting portion wall—central axis radii (115) are greater than or equal to at least two central axis—engagement portion radii (235), thereby allowing an extended portion of the horizontal surface (H) to overhang at least a portion of collecting portion wall (110).

Various additional features may be found in any embodiment of the cleaning tray (10). In some embodiments, as seen in FIGS. 8 and 9, at least a portion of at least one collecting portion wall (110) is oriented at an acute angle to the central axis (105) to improve drainage of the collecting portion volume (130) into the waste container (300). The collecting portion (100) may have at least one collection portion accessory mount (160), as may the attachment portion (200) or the waste container (300). As seen in FIGS. 8 and 9, one skilled in the art will realize that there is almost no limit to the configuration of a collection portion accessory mount (160), which may, by means of example only and not limitation, be formed as a hook, bar, handle, or other appurtenance.

Figure 12:
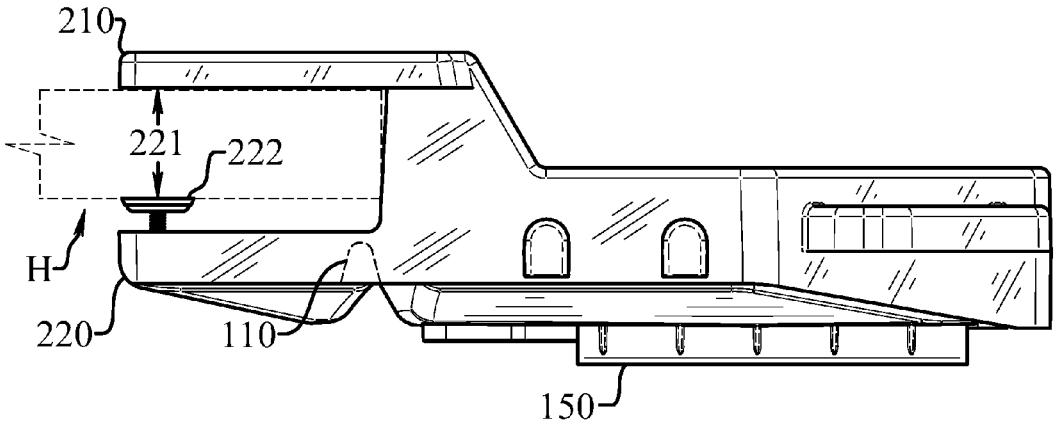
FIG. 12 is another side elevation view of the embodiment of FIG. 9, showing a second position adjustment in the inter-engagement portion height (221).
Figure 12A:
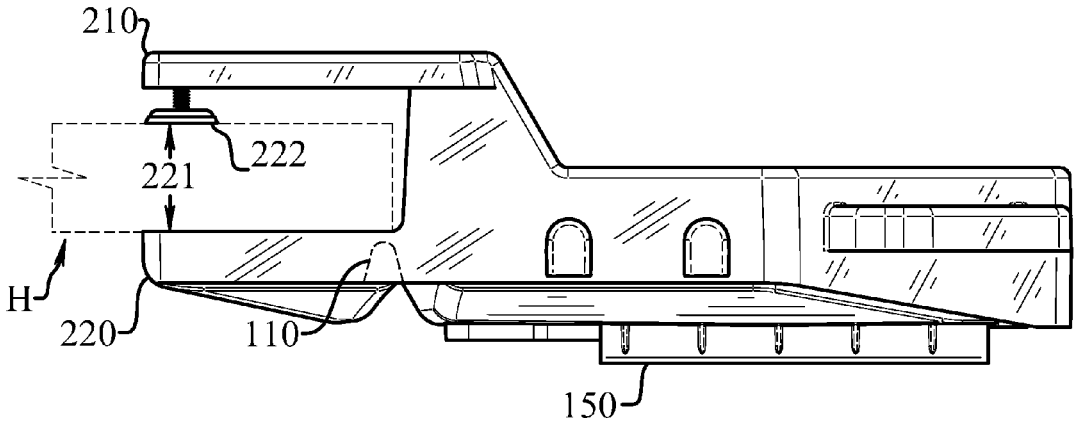
Figure 12B:
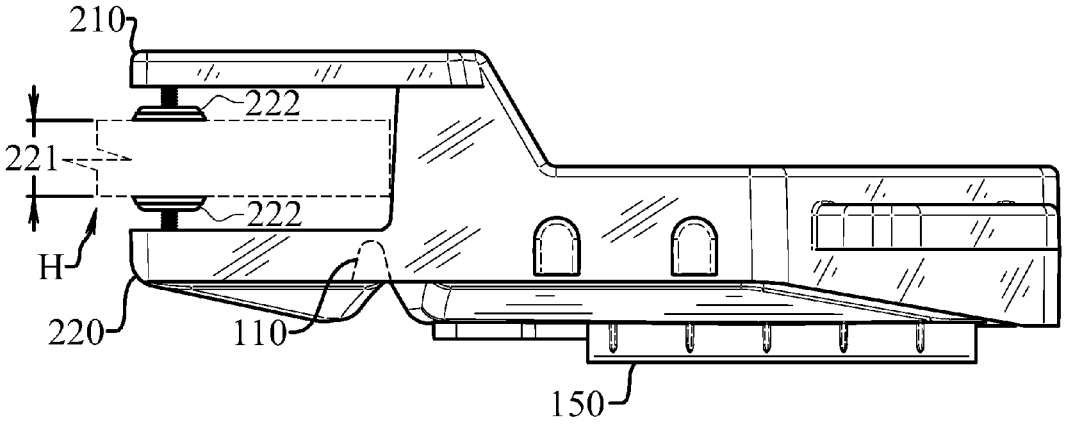

As seen in FIGS. 10-12, the lower engagement portion (210) may have an adjustable engagement portion height adjustment (222). This would allow a variation within the inter-engagement portion height (221), so that a horizontal surface (H) placed within the inter-engagement portion height (221) would fit more tightly. One skilled in the art would realize that just as the lower engagement portion (210) may have an adjustable engagement portion height adjustment (222), the upper engagement portion (220) may have an adjustable engagement portion height adjustment (222), or additionally, that both the upper engagement portion (210) and the lower engagement portion (220) may have an adjustable engagement portion height adjustment (222).

In certain embodiments, the waste container (300) may further include at least one waste container handle (360), as seen in FIG. 10. This may allow easier removal of the waste container (300) from the collecting portion (200), to allow waste to be disposed of. Since embodiments are envisioned in which the waste container volume (330) is at least two, five, or ten times the collecting portion volume (130), a waste container handle (360) may be useful in helping control the weight and handling of the waste container (300).

To prevent premature release of the waste container (300) from the collecting portion (200), the releasable collecting portion—waste container attachment (150) and the releasable waste container—collecting portion engagement (350) may be releasably engagable in a releasably lockable position for use. A plurality of methods for this would be known to one skilled in the art, but may include a releasable locking portion on one of the components that releasably engages the other component.

Numerous alterations, modifications, and variations of preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A cleaning tray (10), having a collecting portion (100), an attachment portion (200) and a waste container (300), wherein;

the collecting portion (100) has a central axis (105), at least one collecting portion wall (110) wherein at least a portion of at least one collecting portion wall (110) is oriented at an acute angle to the central axis (105), enclosing a collecting portion volume (130) in fluid communication with the waste container (300) through a collecting portion fenestration (140), the collecting portion wall (110) spaced at least one predetermined distance from the central axis (105) thereby defining at least one collecting portion wall—central axis radius (115), and a releasable collecting portion—waste container attachment (150);

the attachment portion (200) has an upper engagement portion (210) and a lower engagement portion (220) having a predetermined distance between the upper engagement portion (210) and a lower engagement portion (220) defining an adjustable inter-engagement portion height (221) and releasably engages a horizontal surface (H) placed between the upper engagement portion (210) and the lower engagement portion (220) in the predetermined engagement portion height (221), and an engagement portion stop (230) at a predetermined distance from the collecting portion central axis (105) thereby defining at least one central axis—engagement portion radius (235);

the waste container (300) has at least one waste container wall (310) defining a waste container volume (330) in open fluid communication with the collecting portion (100) through the collecting portion fenestration (140), and a releasable waste container—collecting portion engagement (350); and wherein at least one collecting portion wall—central axis radius (115) is greater than or equal to at least one central axis—engagement portion radius (235).

2. The device according to claim 1 wherein at least two collecting portion wall—central axis radii (115) are greater than or equal to at least two central axis—engagement portion radii (235).

3. The device according to claim 1 wherein the collecting portion has at least one collection portion accessory mount (160).

4. The device according to claim 1 wherein the upper engagement portion (210) has an adjustable engagement portion height adjustment (222).

5. The device according to claim 1 wherein the lower engagement portion (220) has an adjustable engagement portion height adjustment (222).

6. The device according to claim 1 wherein the waste container (300) further comprises at least one waste container handle (360).

7. The device according to claim 1 wherein the releasable collecting portion—waste container attachment (150) and the releasable waste container—collecting portion engagement (350) are releasably engagable in a releasably lockable position for use.

8. The device according to claim 1 wherein the waste container volume (330) is at least two times the collecting portion volume (130).

9. The device according to claim 1 wherein the waste container volume (330) is at least five times the collecting portion volume (130).

10. The device according to claim 1 wherein the waste container volume (330) is at least ten times the collecting portion volume (130).

* * * * *